US007017368B2

(12) United States Patent
Hug

(10) Patent No.: US 7,017,368 B2
(45) Date of Patent: Mar. 28, 2006

(54) ARTICULATED OPEN RING

(75) Inventor: Marco Dominique Hug, Biel/Bienne (CH)

(73) Assignee: Hartcase Corporation, Purchase, NY (US)

( * ) Notice: Subject to any disclaimer, the term of this patent is extended or adjusted under 35 U.S.C. 154(b) by 95 days.

(21) Appl. No.: 10/480,711

(22) PCT Filed: Jul. 10, 2002

(86) PCT No.: PCT/IB02/02706

§ 371 (c)(1),
(2), (4) Date: Dec. 11, 2003

(87) PCT Pub. No.: WO03/005850

PCT Pub. Date: Jan. 23, 2003

(65) Prior Publication Data

US 2004/0172968 A1 Sep. 9, 2004

(30) Foreign Application Priority Data

Jul. 11, 2001 (EP) ..... 01116879

(51) Int. Cl.
*A44C 5/00* (2006.01)
*A44C 19/00* (2006.01)

(52) U.S. Cl. ..... 63/7; 63/3; 63/9; 63/15

(58) Field of Classification Search ..... 63/3, 63/7, 9, 15
See application file for complete search history.

(56) References Cited

U.S. PATENT DOCUMENTS 1,128,084 A * 2/1915 Wilcoxon ..... 63/15.7
3,182,876 A * 5/1965 Sedor et al. ..... 225/101
3,465,543 A * 9/1969 Baker ..... 63/15.5
3,566,616 A * 3/1971 Benedict, Jr. ..... 63/15.7
3,736,770 A * 6/1973 Kelrick ..... 63/15.7
4,236,384 A * 12/1980 Daub ..... 63/7
4,753,087 A * 6/1988 D'Annunzio ..... 63/15.45
4,790,148 A * 12/1988 Faini ..... 63/15.7
4,879,883 A * 11/1989 Bruner ..... 63/15.7
4,991,409 A * 2/1991 Creates ..... 63/15.7
5,069,045 A * 12/1991 Mejias ..... 63/3
5,136,858 A * 8/1992 Bruner ..... 63/15.7
5,651,273 A * 7/1997 Levy ..... 63/15.7
5,816,073 A * 10/1998 Bardisbanyan ..... 63/12
6,085,550 A * 7/2000 Ishida ..... 63/15.65
6,568,214 B1 * 5/2003 Wolff ..... 63/29.1
6,701,746 B1 * 3/2004 Bentley ..... 63/15
2002/0069670 A1 * 6/2002 Rosenberg ..... 63/15.7

FOREIGN PATENT DOCUMENTS

FR 940 506 12/1948

* cited by examiner

*Primary Examiner*—Robert J. Sandy
*Assistant Examiner*—David Reese
(74) *Attorney, Agent, or Firm*—McGlew and Tuttle, P.C.

(57) ABSTRACT

A ring of the type intended to be arranged on a body part of a wearer includes two rigid bent arms (10, 12) and an articulation (14) connecting them. The arms are mobile facing each other at the first (10*a*, 12*a*) of their two ends. A head part (16) is arranged in proximity to the articulation (14) and is arranged so as to be able to occupy a first position, called the locking position, and a second position, called the unlocking position. First and second connecting devices secure the head part respectively to the first and second arms. These locking devices are both locked when the head part (16) is in the locked position. At least the first of the locking devices is disengaged when the head part is in the unlocked position.

18 Claims, 8 Drawing Sheets

ARTICULATED OPEN RING

FIELD OF THE INVENTION

The present invention relates to an articulated ring. The term "ring" is to be taken in the broad sense, namely an object of annular shape capable of being secured to a body part of generally cylindrical shape. This body part can be a wrist, the ring being a bracelet, but also a neck, the ring then being a necklace, or a finger, in which case it will be a ring.

This invention concerns more particularly a ring of the type including two rigid bent arms and an articulation connecting them, said arms being mobile, one facing the other at the first of their two ends. This ring is arranged so as to be able to occupy two positions, an open position in which the second ends are separated, such that the body part of the person wearing it can be slipped in or out of the ring through the gap that separates them, and a closed position, in which the gap between the second ends is reduced, the arms surrounding the wearer's body part.

BACKGROUND OF THE INVENTION

This type of ring is used in particular in wristwatches, which are known by the name of a "marquise". The fact that the arms are rigid offers original aesthetic possibilities. In this type of watch, both arms are held by means of a spring that tends to bring them close to each other. The return force of the spring plays an important role. If it is too weak, there is a risk of the watch being lost, by an inadvertent opening of the arms. If it is too strong, it is less easy to remove the watch from the wrist.

French Patent document No. FR 940 506 proposes to overcome this drawback. It relates to a watch that includes:

two rigid bent arms and an articulation connecting them, said arms being mobile facing each other at the first of their two ends, a head part, mounted so as to pivot on one of the arms, and a locking portion mounted so as to pivot on the other arm and co-operating with the head part to define a position in which the head part and locking portion are locked.

With such a solution, the risk of inadvertent unlocking is not negligible, by the locking portion becoming caught for example. Moreover, the large number of articulations can cause the appearance of shake that can affect the comfort and even the security of the wearer. More precisely, according to the invention, the ring is of the type intended to be arranged on a wearer's body part and it includes:

- two rigid bent arms and an articulation connecting them, said arms being mobile facing each other at the first of their two ends,
- a head part arranged in proximity to the articulation and arranged so as to be able to occupy a first position, called the locking position, and a second position, called the unlocking position, and
- first and second connecting means for securing the head part respectively to the first and second arms, said means both being locked when the head part is in the locking position and at least the first of said means being disengaged when the head part is in the unlocked position The arms are arranged to occupy:

- an open position in which their second ends are separated, such that the ring can be slipped onto or off the wearer's body part through the gap that separates them, and
- a closed position in which this gap is reduced, the arms surrounding the wearer's body part.

SUMMARY OF THE INVENTION

The object of the present invention is to make a ring as defined hereinbefore, which is easy to put on and take off, while guaranteeing the wearer a high level of security and reliability. This object is achieved owing to the fact that the first connecting means include first and second parts rigidly associated respectively with the first arm and the head part. In other words, the first and second parts of the first connecting means are either integral with the first arm and the head part, or added onto and rigidly secured to the latter, by welding, for example. Such a structure guarantees the assembly proper rigidity, reduces the risk of inadvertent unlocking and allows numerous variants from the aesthetic point of view.

The first and second parts of the connecting means are advantageously formed, one by a locking portion and the other by a hook portion intended to co-operate with each other when the head part is in the locked position and released from each other when the head part is in the unlocked position.

In order to assure stable positioning of the head part on the arms, the first connecting means are arranged such that the movement of the head part from its locked position to its unlocked position occurs by applying a first force F1, and in that a force F2 applied on one of the arms when the head part is in the locked position generates thereon, via the interaction of the locking portion and the hook portion, a resulting force F3 substantially perpendicular to first force F1, all such that the arms remain in the closed position as long as the head part is in the locked position and can be separated from each other when the head part is in the unlocked position.

In order to allow the articulation good working conditions, the latter includes at least one hinge secured to at least one of the arms and which defines a first pivoting axis, the hinge being masked when the head part is in the locked position and exposed in the unlocked position.

In a first embodiment, the articulation further includes a second hinge pivoting about an axis parallel to the first axis, and a plate connecting the first hinge to the second, one of the hinges being secured to one of the arms, the other to the other arm.

In a second embodiment, the head part is arranged so as to be able to pass from one of the locking and unlocking positions to the other by sliding into at least one of the arms.

In order to assure proper positioning of the head part with reference to the arms, in the locked position, the ring further includes positioning means of the snap-fitting type arranged to co-operate on the one hand with the head part, and on the other hand with one of the arms.

According to a third embodiment, the head part is arranged to pass from one of the locking and unlocking positions to the other by rotating about a second axis perpendicular to the first axis.

Advantageously, at least one of the arms of the bracelet includes a protuberance and the head part includes a wing, one of them forming the locking portion and the other the hook portion.

In a fourth embodiment, the head part is mounted so as to pivot on one of the arms via one of its ends, about a third axis parallel to the first axis, and it co-operates, via the other end, with the other arm to form a snap-fitting type assembly.

The ring can advantageously be used as a wristwatch. A particularly interesting solution consists in arranging, in the head part, a timekeeping device provided with two distinct displays, the connecting means being arranged such that the head part can occupy two locking positions and such that the displays are respectively visible in the first and second of these positions.

Other advantages and features of the invention will appear from the following description, made with reference to the annexed drawing. All the embodiments of the invention described hereinafter thus relate to a bracelet provided with a case in which a watch movement is housed. The technical means implemented can be applied to a necklace or to a ring, by an adjustment of scale. The presence of a watch movement does not play an essential role either. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
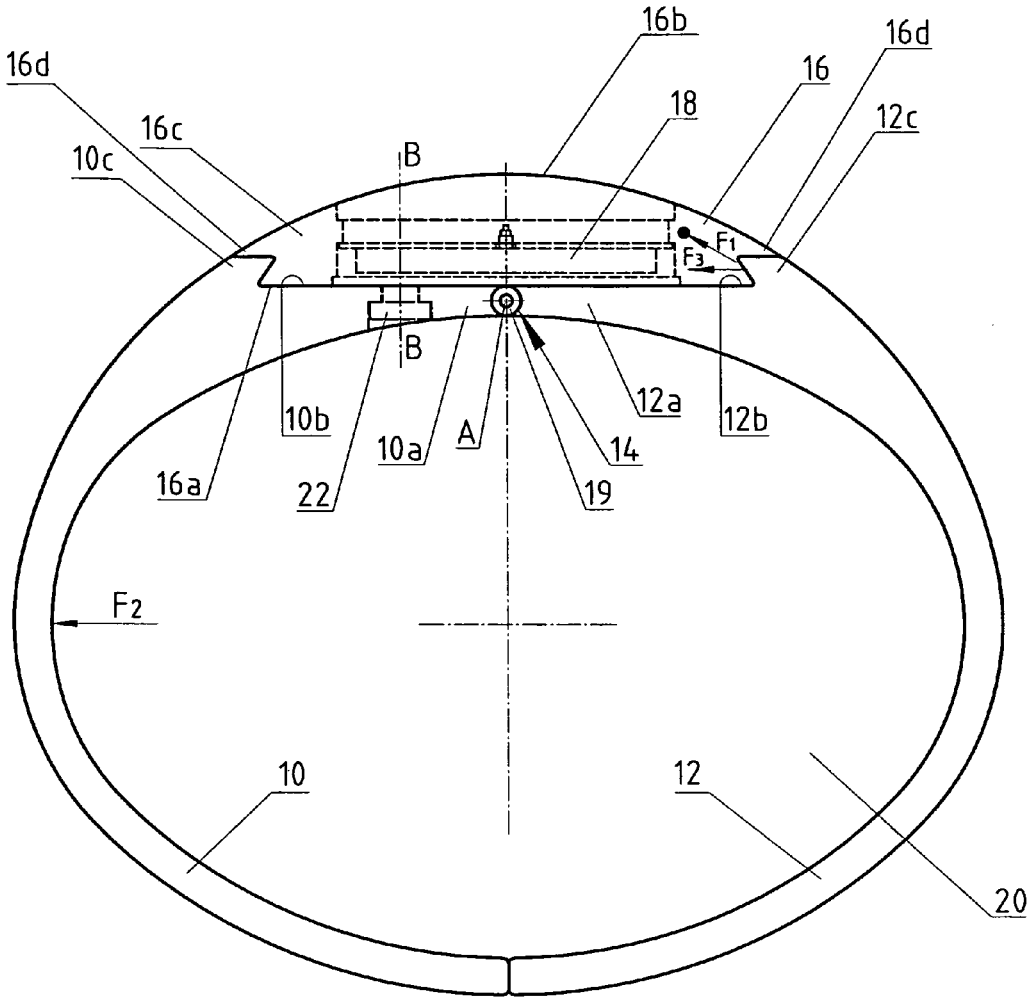
FIG. 1*a* is a side views of a first embodiment of a bracelet according to the invention, with the head part in the locked position.

Referring to the drawings in particular, each of the bracelets shown in FIGS. 1 to 4 include two rigid bent arms 10 and 12, an articulation 14 connecting them to each other via one of their ends, identified by the letter A, and a mobile head part 16 taking the form of a case inside which a watch movement 18 is housed.

In FIG. 1, the two arms 10 and 12, in the closed position, each embrace an angle of approximately 180°, together forming a ring with an opening 20 for receiving the wearer's wrist. Their connected ends 10*a* and 12*a* are provided with coaxial holes in which a pin of axis A—A is engaged to form a hinge 19 forming articulation 14. These ends each further include a plane surface identified by the letter b which are coplanar. A protuberance identified by the letter C limits surfaces 10*b* and 12*b* on their side opposite to articulation 14.

Head part 16 is mounted so as to pivot at end 10*a* of arm 10, about an axis B—B perpendicular to surface 10*b*, by means of a stud with a head 22 which is secured thereto, engaged in a hole made in end 10*a* of arm 10, as can be seen in FIG. 1*a*. Stud 22 thus performs the function of connecting means between arm 10 and head part 16. The latter includes a lower plane face 16*a*, adjacent to surfaces 10*b* and 12*b* in the locked position and onto which stud 22 is secured, an upper domed face 16*b*, two lateral faces 16*c* and two wings 16*d* intended to co-operate with protuberances 10*c* and 12*c*.

More precisely, with surfaces 10*b* and 12*b*, protuberances 10*c* and 12*c* form hook portions and the two wings 16*d* locking portions, each co-operating with one of the hook portions, so as to secure head part 16 to arms 10 and 12. In other words, the hook portions and the locking portions respectively form the first and second parts of the means for connecting arms 10 and 12 to head part 16. In this embodiment, these connecting means are both disengaged when head part 16 is in the position shown in FIG. 1*b*.

When the head part is in the locked position, shown in FIG. 1*a*, head part 16 enters the general shape of the bracelet, upper surface 16*b* extending arms 10 and 12 and hinge 19 being covered. In order to disconnect head part 16 and arms 10 and 12, a force F1 has to be applied on one of lateral faces 16*c*, substantially perpendicular to the plane of the drawing, which causes head part 16 and stud 22 to pivot on arm 10, such that wings 16*d* are disconnected from protuberances 10*c* and 12*c*. The rotation has to be approximately 90°. The head part then reaches its unlocked position.

Figure 1B:
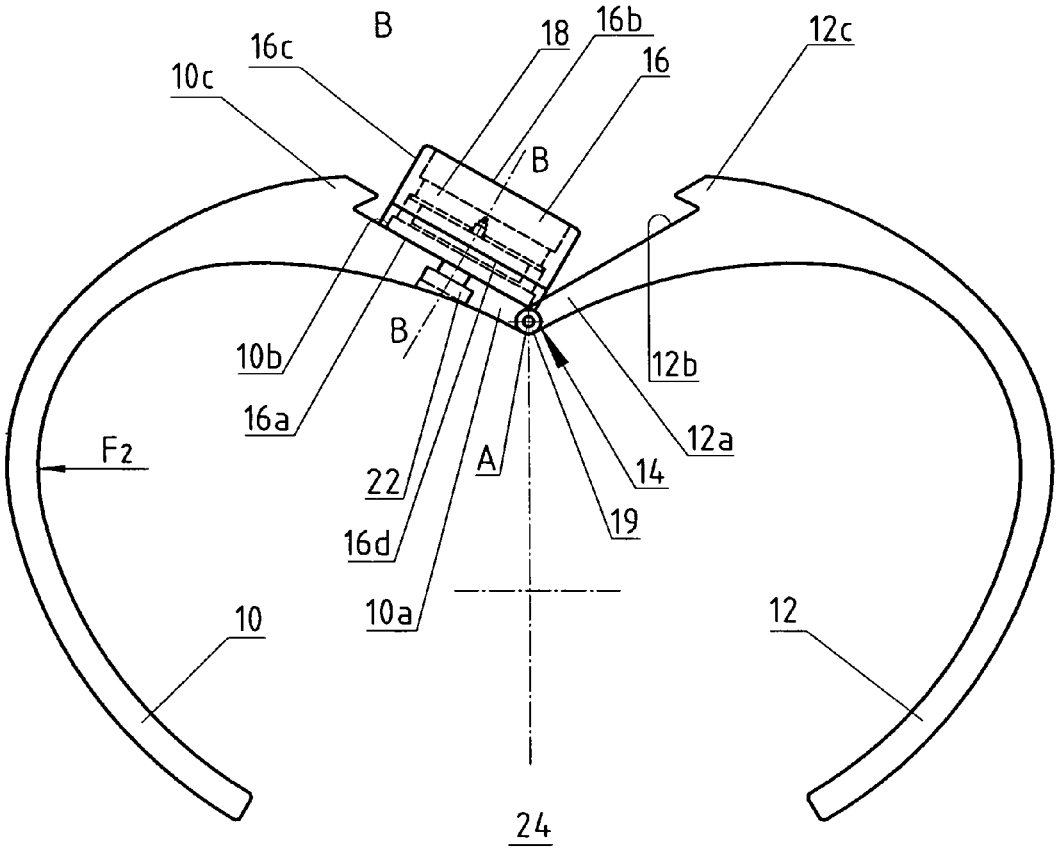
FIG. 1*b* is a side views of a first embodiment of a bracelet according to the invention, with arms open and head part in the unlocked position.

In this position, the application, in the median part of arms 10 and 12, of a force F2 in a perpendicular plane to axis A—A and oriented outwards, so as to generate a torque with respect to such axis, causes arms 10 and 12 to separate, forming between them, a gap 24 which increases until it reaches the open position shown in FIG. 1*b*, in which it is possible to remove or insert the wearer's wrist.

If, conversely, when the arms are in the closed position and the head part is in the locked position, force F2 is applied, this force generates a resulting force F3 applied either by surfaces 10*b* and 12*b* on face 16*a*, or by protuberances 10*c* and 12*c* on wings 16*d*. Surface 12*b* and face 16*a* or protuberance 10*c* and wing 16*d* with which it co-operates, thus form second connecting means securing the head part to arm 10, but only when the head part is in the locked position.

Force F3 is perpendicular to F1 and substantially parallel to axis B—B when it is surface 12*b* and face 16*a* that form the second connecting means, whereas it is substantially perpendicular to axis B—B in the other case, which is shown in FIG. 1*a*. F3 has the effect of generating a stress at stud 22, but without thereby causing a movement of head part 16 with reference to arms 10 and 12. Head part 16 is thus locked and arms 10 and 12 remain closed.

When the arms are in the open position, head part 16 being in the unlocked position as shown in FIG. 1*b*, one need only apply a contrary force to F2 onto arms 10 and 12 until said arms 10 and 12 are in the closed position, the free ends of arms 10 and 12 forming a stop member. In this position, surfaces 10*b* and 12*b* are, again, coplanar, such that by applying, onto the other lateral face 16*c*, a force of opposite direction to F1, the latter returns head part 16 to its locked position.

It is clear that arms 10 and 12 can only be open insofar as articulation 14 can work freely. This is only possible if head part 16, in the unlocked position, completely releases surface 12*b*, and hinge 19. Arm 12 is thus no longer limited in its movement by face 16*a*. This condition is only satisfied if the distance between axis B—B and edge 16*c* is less than the distance comprised between axes A—A and B—B.

In a variant that has not been shown, the arms could also co-operate with a spring, as happens in marquise watches, such that, when put on, the latter automatically take their closed position.

In another variant, it is also possible to mount head part 16 on arm 10 in a removable manner. This can easily be achieved by arranging stud 22 and the hole made in arm 10 so as to form a bayonet type lock. In this case, disengagement will advantageously occur after a rotational angle greater than 90°, so that the risk of accidental unlocking is removed.

The embodiment shown in FIG. 2 differs from that of FIG. 1 in the symmetrical structure of head part 16 and in its articulation 14. The other features are similar and identified by the same references.

Articulation 14 includes a plate 26 connecting the two ends 10*a* and 12*a* and forming with them two hinges 28 and 30 pivoting about parallel axes A—A and A'—A'.

Figure 2A:
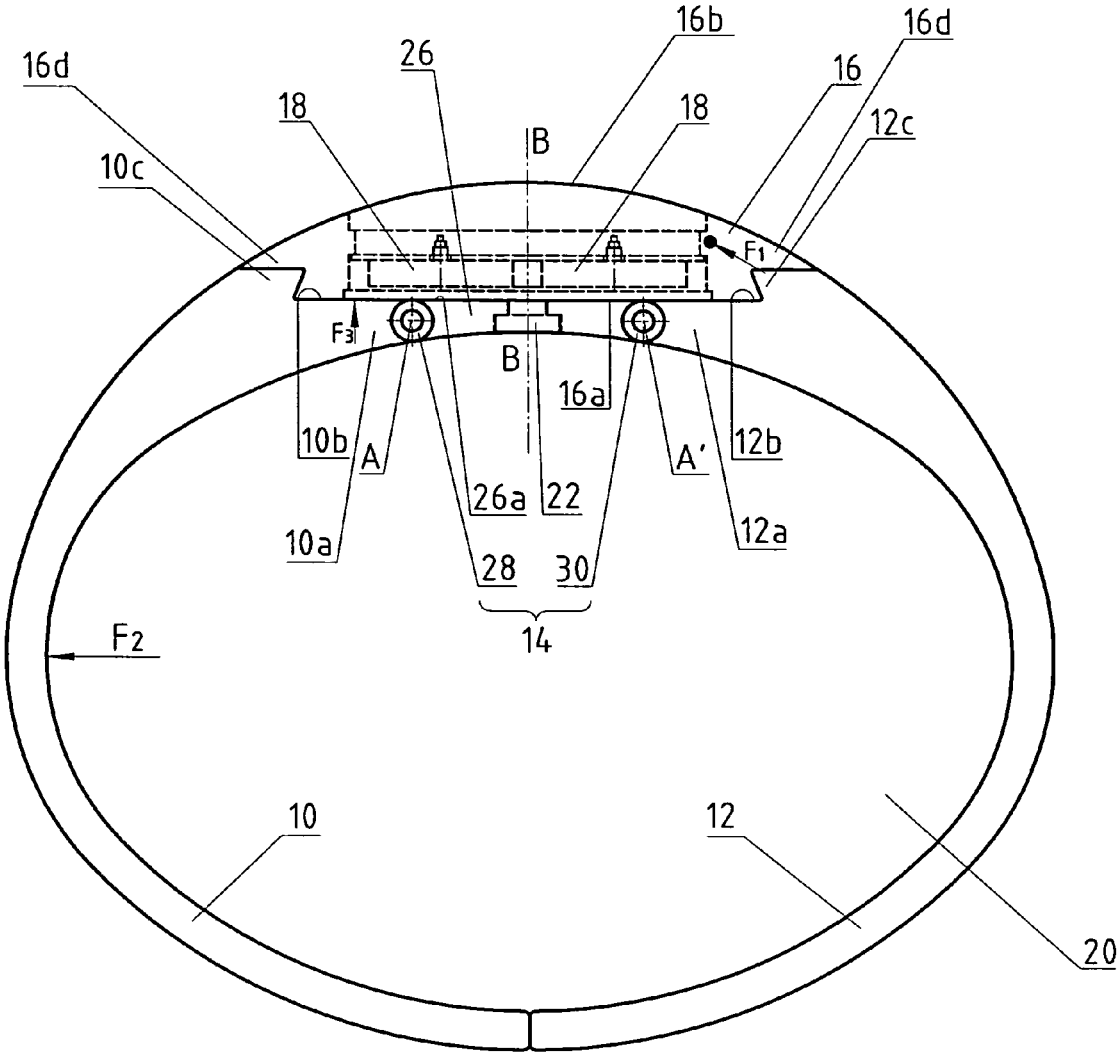
FIG. 2*a* is a side views of a second embodiment of a bracelet according to the invention, with the head part in the locked position.

Plate 26 has a support surface 26*a* which, when the arms are in a closed position as shown in FIG. 2*a*, is in the extension of surfaces 10*b* and 12*b*. Surface 26*a* is of substantially square shape, with its sides equal to or greater than the width of head part 16.

Head part 16 is mounted so as to pivot on plate 26, about an axis B—B perpendicular to surface 26*a* and passing through its center, by means of a stud 22, similar in all respects to that used in the embodiment of FIG. 1. Stud 22 thus performs the function of connecting means between head part 16 and plate 26.

Since head part 16 is symmetrical, it is possible to make it rotate completely about axis B—B. Consequently, by arranging two watch movements 18 in head part 16, displaying different times, it is possible to select the time displayed simply by rotating the head part.

Figure 2B:
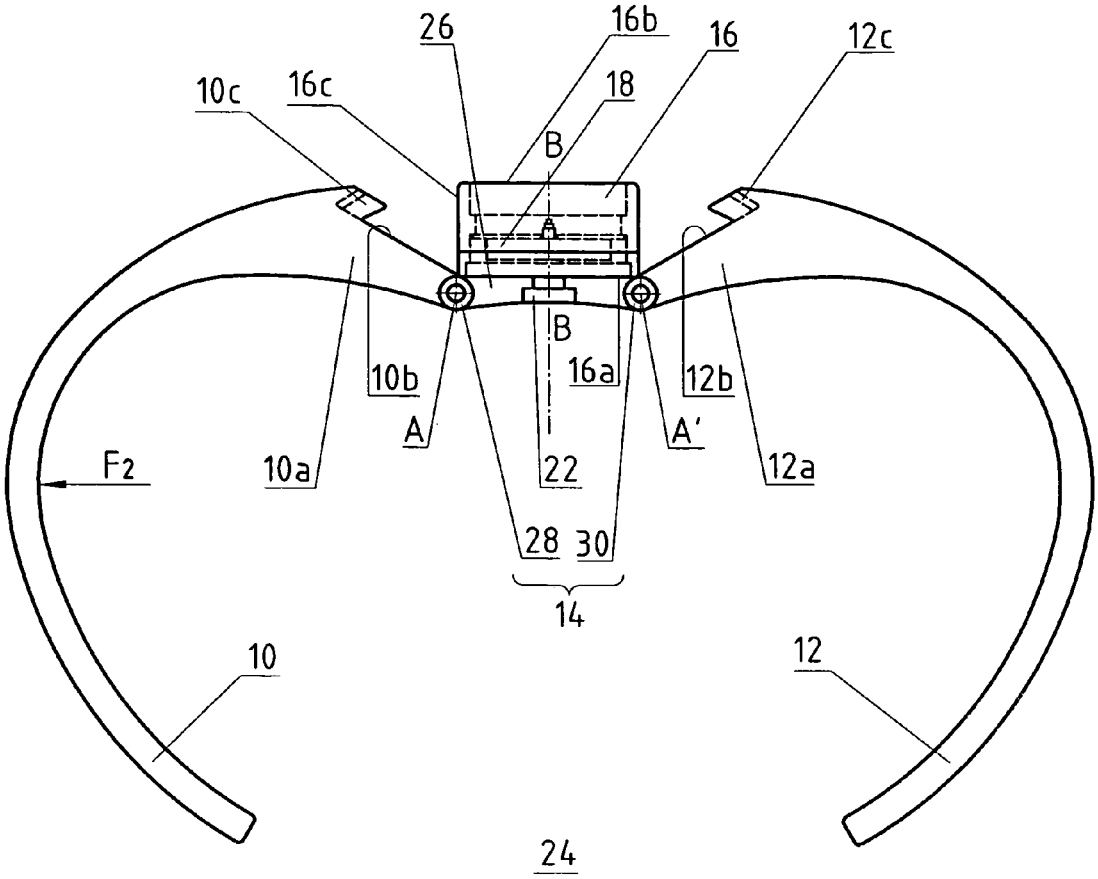
FIG. 2*b* is a side views of a second embodiment of a bracelet according to the invention, with arms open and head part in the unlocked position.

In the locked position, shown in FIG. 2*a*, head part 16 enters the general shape of the bracelet, upper surface 16*b* extending arms 10 and 12. In order to separate head part 16 and arms 10 and 12, a force F1 has to be applied, substantially perpendicular to the plane of the drawing, on one of lateral faces 16*c*, which causes head part 16 and stud 22 to pivot on plate 26, such that wings 16*d* are separated from protuberances 10*c* and 12*c*. The rotation has to be approximately 90°. The head part then reaches its unlocked position. In this position, in which the two hinges 28 and 30 are exposed, the application, in the median part of arms 10 and 12, of a force F2 in a plane perpendicular to axes A—A and A'—A', and oriented outwards, so as to generate a torque with respect to these axes, causes arms 10 and 12 to separate, thus forming between them a gap 24 that increases until the open position shown in FIG. 2*b* is reached, in which it is possible to remove or insert the wearer's wrist.

If, conversely, when the arms are in the closed position and head part 16 is in the locked position, force F2 is applied, this force generates a resulting force F3 applied either by surfaces 10*b* and 12*b* onto face 16*a*, as shown in FIG. 2*a*, or by protuberances 10*c* and 12*c* on wings 16*d*.

Surfaces 10*b* and 12*b* co-operating with face 16*a* or protuberances 10*c* and 12*c* with wings 16*d* thus form means for connecting the head part to arms 10 and 12. In this case, the two head part and arm connecting means are disengaged in the unlocked position, the permanent connecting function being assured by stud 22 mounted on plate 26.

When it is surfaces 10*b* and 12*b* which generate resulting force F3, the latter is then substantially perpendicular to F1 and F2 and parallel to axis B—B, which has the effect of generating a stress at stud 22, but without thereby causing a movement of head part 16 with reference to arms 10 and 12. Head part 16 is thus locked and arms 10 and 12 remain closed.

When the arms are in the open position, head part 16 being in the unlocked position, as shown in FIG. 2*b*, one need only apply an opposite force to F2 on arms 10 and 12, until arms 10 and 12 are in the closed position, the free ends of arms 10 and 12 forming a stop member. In this position, surfaces 10*b* and 12*b* are, again, coplanar, such that by applying, on the other lateral face 16*c*, a force of opposite direction to F1, the latter returns head part 16 to its locked position.

It is clear that arms 10 and 12 can only be open insofar as articulation 14 can work freely. This is only possible if head part 16, in the unlocked position, releases surfaces 10*b* and 12*b* completely, said surfaces no longer being limited in their movement by face 16*a*. This condition is only satisfied if the distance between axis B—B and edge 16*c* is less than the distance comprised between B—B and axes A—A and A'—A'.

As bracelet head part 16 described with reference to FIG. 2 is symmetrical, it can occupy two locking positions, passing from one to the other by a rotation of 180°. If it is provided with two watch movements 18 and, consequently a double time display, it allows two items of data to be displayed, for example the times of two time zones, the passage from one to the other occurring via a simple rotation of head part 16.

In this case also, head part 16 can be removably mounted on plate 26 by means of a bayonet type assembly.

FIG. 3 shows a bracelet differing from the two previously described examples, in that head part 16 is mounted so as to slide on support surfaces 10*b* and 12*b*. In this configuration, articulation 14 is identical to that of FIG. 1, formed of two coaxial hinges 30, of axis A—A, only one being visible in the drawing, separated by a space. In this Figure too, the same parts bear the same references as in FIGS. 1 and 2.

Head part 16 includes, as in the two examples described hereinbefore, a lower plane face 16*a*, adjacent to surfaces 10*b* and 12*b* in the locked position and on which stud 22 is fixed, an upper domed surface 16*b* and two lateral faces 16*c*. In this case, however, upper surface 16*b* joins lower face 16*a* at each of the ends, such that head part 16 has a cross-section having the shape of a cylinder segment, of parallel axis to axis A—A.

More precisely, surfaces 10*b* and 12*b* include a groove 32, perpendicular to axis A—A and of T-shaped section, acting as a slide-way. Stud 22 is provided with a projecting portion 22*a*, engaged in groove 32 to form a slide and thus perform a connecting function between head part 16 and arm 10.

A spring ball-fitted pawl 34 is housed in arm 10 and projects from surface 10*b* in proximity to its end opposite to articulation 14. A conical hole 36 is made in face 16*a*, arranged such that ball 34 is housed therein when head part 16 is in the locked position.

Figure 3A:
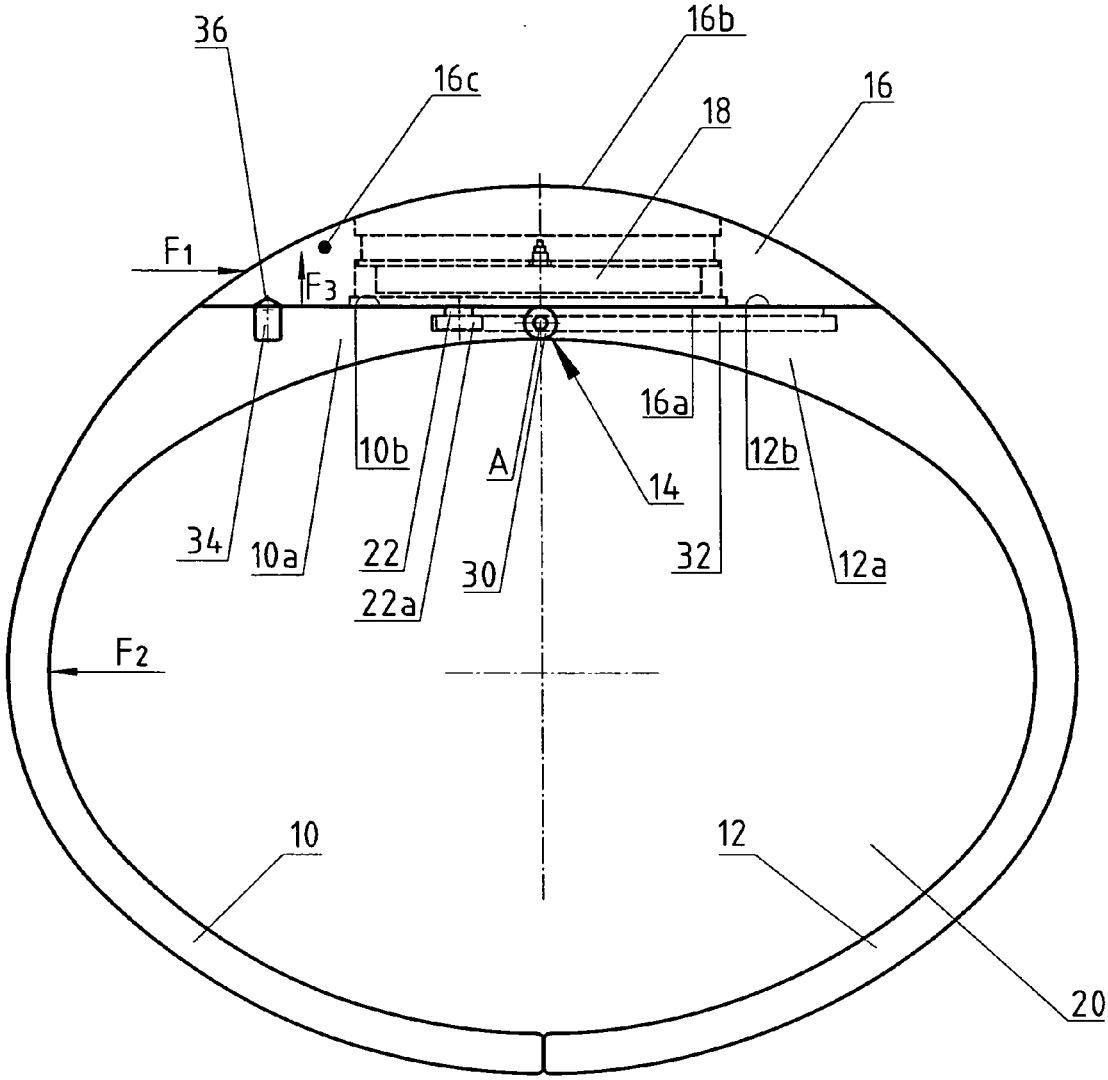
FIG. 3*a* is a side views of a third embodiment of a bracelet according to the invention, with the head part in the locked position.

When the head part is in the locked position, shown in FIG. 3*a*, head part 16 enters into the general shape of the bracelet, upper surface 16*b* extending arms 10 and 12. Stud 22 is engaged in the part of groove 32 associated with arm 10. Head part 16 is held in this position by the engagement of ball 34 in conical hole 36.

In order to separate head part 16 and arms 10 and 12, a force F1 has to be applied onto upper face 16*b*, substantially oriented parallel to groove 32 and within the plane of the drawing. This force F1, overcomes the positioning force of ball 34 and causes head part 16 to slide, until stud 22 reaches the other end of groove 32, which corresponds to the unlocked position of head part 16.

Figure 3B:
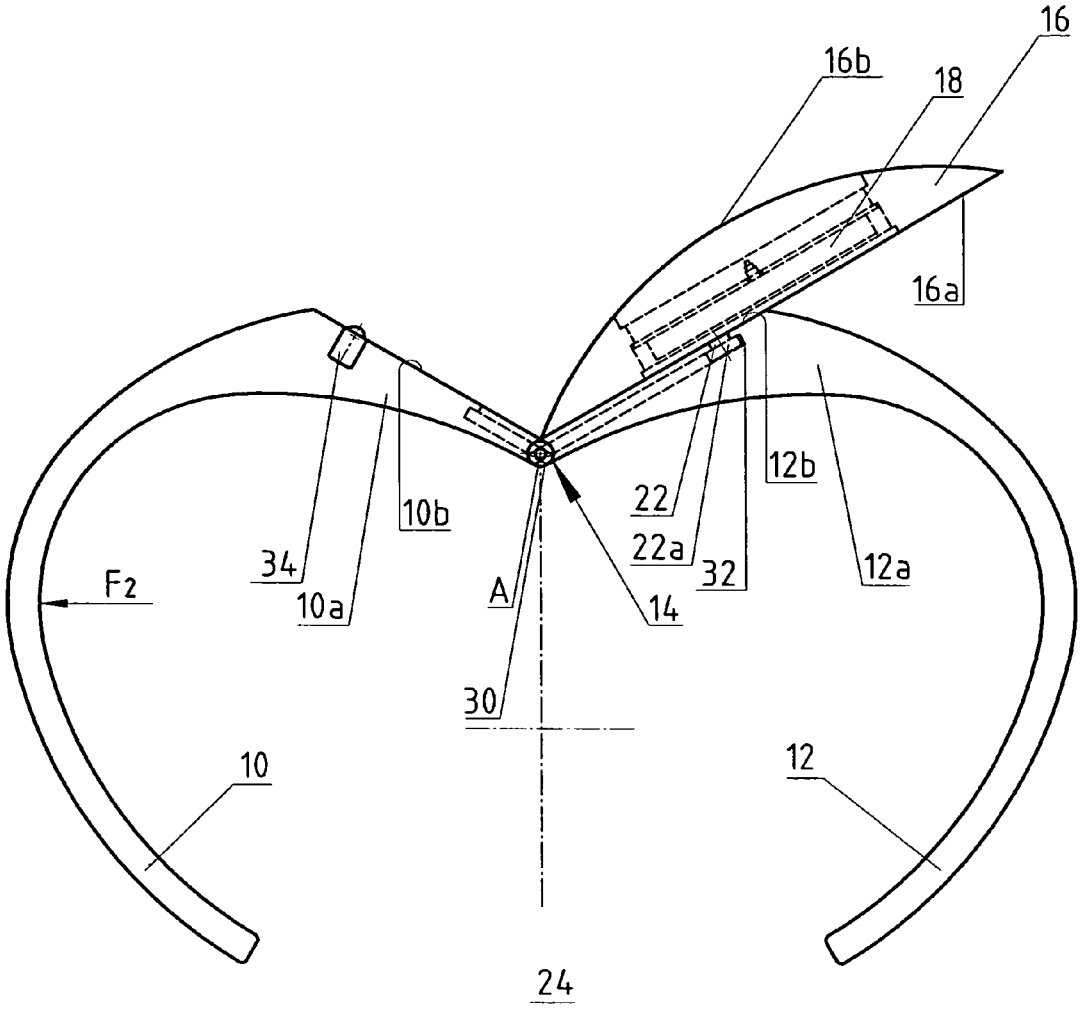
FIG. 3*b* is a side views of a third embodiment of a bracelet according to the invention, with arms open and head part in the unlocked position.

In this position, the application, in the median part of arms 10 and 12, of a force F2 within a perpendicular plane to axis A—A and oriented outwards, so as to generate a torque with respect to this axis, causes arms 10 and 12 to separate, forming between them a gap 24 that increases until the open position shown in FIG. 3*b* is reached, in which it is possible to remove or insert the wearer's wrist.

If, conversely, when the arms are in the closed position and the head part 16 is in the locked position, a force F2 is applied, this force generates a resulting force F3 perpendicular to F1, applied by surfaces 10*b* and 12*b* on face 16*a*, which has the effect of generating a stress at stud 22, but without thereby causing a movement of head part 16 with reference to arms 10 and 12. Surfaces 10*b* and 12*b* with face 16*a* thus perform the function of connecting means between head part 16 and arm 12. Head part 16 is thus locked and arms 10 and 12 remain closed, head part 16 acting as a locking portion and arms 10 and 12 as a hook portion.

When the arms are in the open position, head part 16 being in the unlocked position, as shown in FIG. 3*b*, one need only apply an opposite force to F2 onto arms 10 and 12 until arms 10 and 12 are in the closed position, the free ends of arms 10 and 12 forming a stop member. In this position, surfaces 10*b* and 12*b* are, again, coplanar, such that by applying, on the other side of upper face 16*a*, a force of opposite direction to F1, it returns head part 16 to its locked position.

It is clear that arms 10 and 12 can only be open insofar as articulation 14 can work freely. This is only possible if head part 16 completely releases surface 10*b* and hinges 30 in the unlocked position. Arm 10 is then no longer limited in its movement by face 16*a*. This conditions is only satisfied if the length of groove 32 is at least equal to the distance comprised between articulation 14 and the end of face 16*a* where force F1 is applied.

In a variant that has not been shown, it is possible to remove head part 16 from the bracelet by arranging projecting portion 22*a* such that by rotating head part 16 when it is in the unlocked position, it can be removed from groove 32.

In this embodiment, it would also be possible to offset the hinge forming articulation 14, such that groove 32 is only made in arm 12. In this case, surface 10*b* is less than surface 12*b*. Furthermore, the movement of head part 16, in order to pass from one of the locked and unlocked positions to the other is thus reduced.

It should be stressed that in the embodiment of FIG. 3, the means for connecting arm 12 to head part 16 remain engaged both in the locked and unlocked position of head part 16.

In the embodiment of FIG. 4, with regard to which the parts common to the other embodiments bear the same references, head part 16 is mounted so as to pivot on end 12*a* of arm 12, about an axis C—C parallel to axis A—A, by means of a hinge 36. The latter performs the function of connecting means between arm 12 and head part 16, which includes a lower plane face 16*a*, adjacent to surfaces 10*b* and 12*b* in the locked position, an upper domed surface 16*d*, two lateral faces 16*c*, a first wing 16*d* intended to co-operate with protuberances 10*c* and a second wing 16*e* arranged to form hinge 36 with protuberance 12*c*.

Protuberance 10*c* forms a hook portion and wing 16*d* a locking portion, which co-operate with each other so as to secure head part 16 to arms 10 and 12, wing 16*d* being snap-fitted onto protuberance 10*c* and thus assuring the function of connecting means between head part 16 and arm 10. This snap-fitting arrangement can be achieved by protuberance 10*c* slightly covering wing 16*d*, arms 10 and 12 being sufficiently resilient to allow the deformation necessary for head part 16 to be released. It is also possible to achieve this function by means of a spring ball-fitted pawl similar to that mentioned with reference to FIG. 3. Moreover, hinge 36 performs the function of connecting means between arm 12 and head part 16.

Figure 4A:
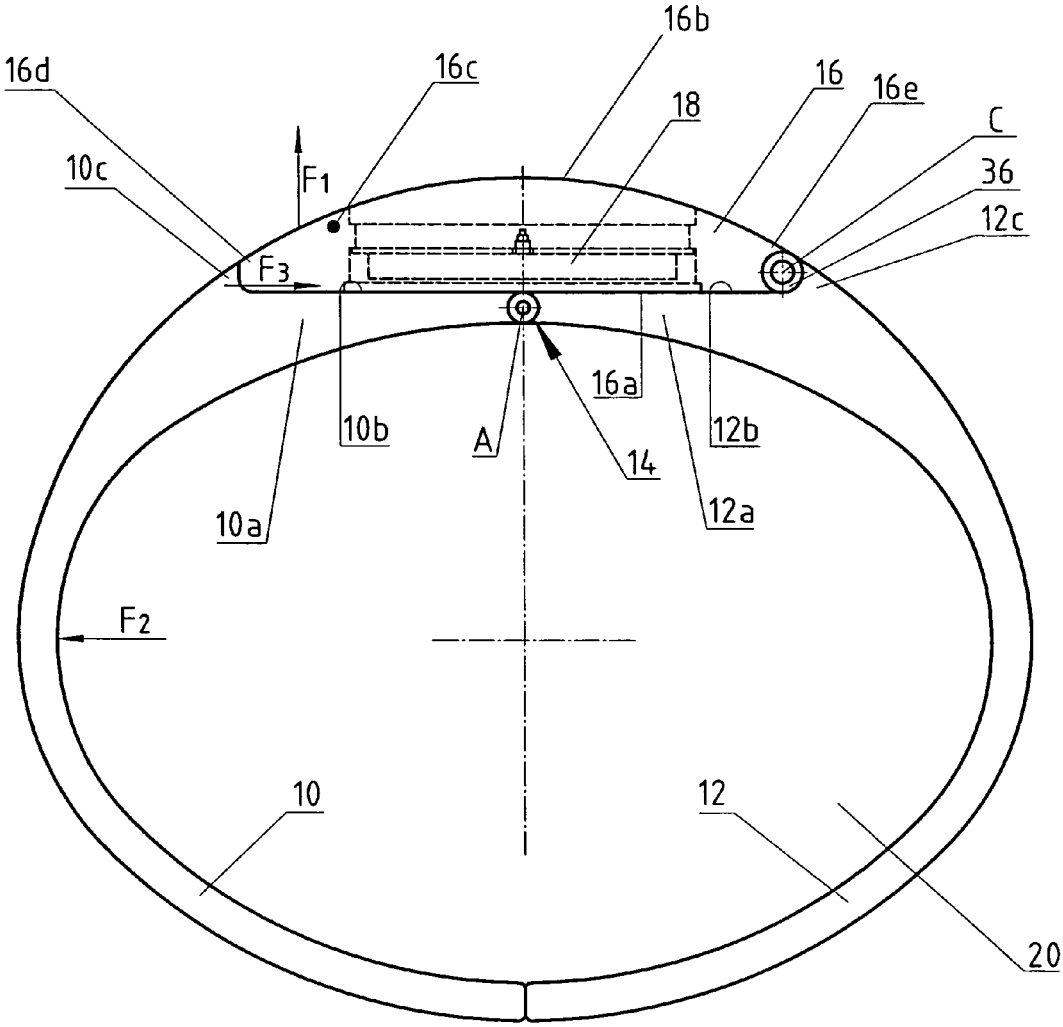
FIG. 4*a* is a side views of a fourth embodiment of a bracelet according to the invention, with the head part in the locked position.

When the head part is in the locked position, shown in FIG. 4*a*, part 16 enters into the general shape of the bracelet, upper surface 16*b* extending arms 10 and 12.

In order to separate head part 16 and arms 10 and 12, a force F 1 has to be applied, oriented upwards, gripping head part 16 by its lateral faces 16*c*. F1 causes head part 16 to pivot on arm 12, owing to hinge 36, such that wing 16*d* separates from protuberance 10*c*. As soon as wing 16*d* is released from protuberance 10*c*, the head part is unlocked.

Figure 4B:
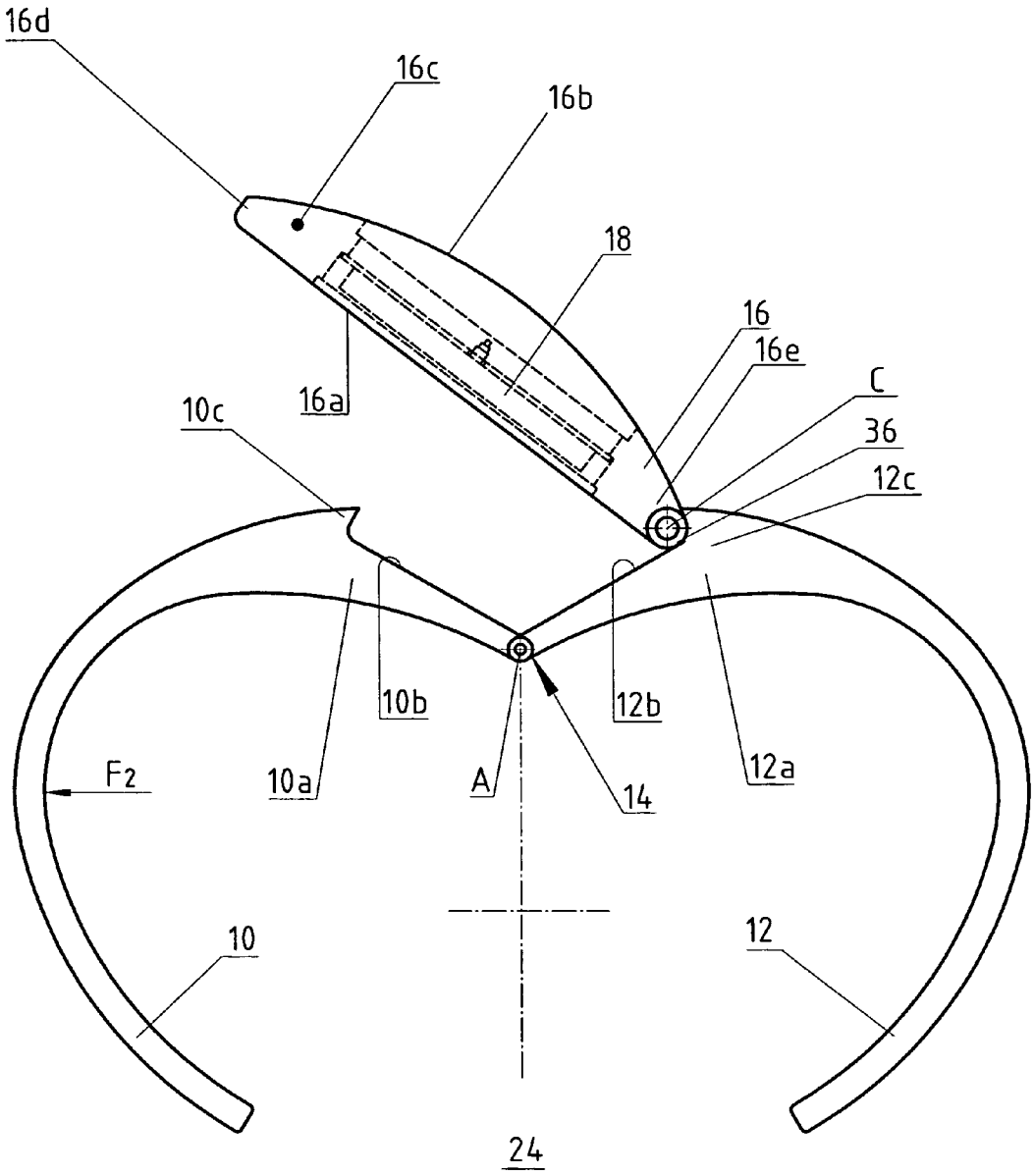
FIG. 4*b* is a side views of a fourth embodiment of a bracelet according to the invention, with arms open and head part in the unlocked position.

In this position, the application, in the median part of arms 10 and 12, of a force F2 within a perpendicular plane to axis A—A and oriented outwards, so as to generate a torque with respect to this axis, causes arms 10 and 12 to separate, forming between them a gap 24, which increase until the open position shown in FIG. 4*b* is reached, in which it is possible to remove or insert the wearer's wrist.

If, conversely, when the arms are in the closed position and the head part is in the locked position, a force F2 is applied, this force generates a resulting force F3 by protuberance 10*c* on wing 16*d*. Force F3 is perpendicular to F1, which has the effect of generating a stress at hinge 36, but without thereby causing head part 16 to move with reference to arms 10 and 12. Head part 16 is thus locked and arms 10 and 12 remain closed.

When the arms are in the open position, head part 16 being in the unlocked position, as shown in FIG. 4*b*, on need only apply an opposite force to F2 to arms 10 and 12 until arms 10 and 12 are in the closed position, the free ends of arms 10 and 12 forming a stop member. In this position, surfaces 10*b* and 12*b* are, again, coplanar, such that, by applying, onto upper surface 16*b*, a force of opposite direction to F1, it returns head part 16 to its locked position.

In this embodiment, only the first connecting means, which connect arm 10 to head part 16, are disengaged when the head part is in the unlocked position.

The four embodiments described show that the ring according to the invention can be the subject of numerous variants. Other variants can also be envisaged, without thereby departing from the scope of the invention. As mentioned hereinbefore, it is possible to make not only bracelets, but also necklaces or rings, for example.

The shape both of arms 10 and 12 and of head part 16 can be changed considerably. It is thus not necessary for surfaces 10*b*, 12*b* and 16*a* to be plane. They could also be spherical, in the first two embodiments, cylindrical in the third and of any shape in the fourth embodiment.

In another embodiment that has not been shown, the head part could carry a cabochon or cut stone, rather than being provided with a watch movement. It would also be possible to fix the movement in one of the arms of the bracelet and for it to be partially masked or not. If the display is masked, it can be read by moving head part 16, but without bringing the latter as far as its unlocked position, in order to prevent opening the bracelet inadvertently.

In the variant of FIG. 4, movement 18 could be housed in arm 12 and head part 16 could surround the housing of movement 18 to form a bezel.

It should be noted finally that the two arms 10 and 12 can embrace an angle of less than 180°. In this case, however, ends 10*a* and 12*a* will be arranged so as to form a stop member when the arms are in the closed position.

It thus appears that, in all the embodiments described, in which the connecting means are rigidly associated with arms 10 and 12, and with head part 16, it is possible to make different variants of bracelets all offering reliable assembly conditions and particularly original aesthetic possibilities.

While specific embodiments of the invention have been shown and described in detail to illustrate the application of the principles of the invention, it will be understood that the invention may be embodied otherwise without departing from such principles.

The invention claimed is:

1. A ring intended to be arranged on a body part of a wearer, the ring comprising:

two rigid bent arms;

an articulation connecting first ends of said arms, said arms being mobile facing each other at said first ends;

a head part arranged in proximity to the articulation and arranged so as to be able to occupy a first position, called the locking position, and a second position, called the unlocking position; and first and second connecting means for securing the head part respectively to the first and second arms, said first and second connecting means both being locked when the head part is in the locked position and at least the first of said connecting means being disengaged when the head part is in the unlocked position, the arms being arranged to occupy:

an open position in which the arms second ends are separated, such that the ring can be slipped onto or off the wearer's body part through a gap that separates the arms second ends, and a closed position in which the gap is reduced, the arms capable of surrounding the wearer's body part, the first connecting scans including first and second parts rigidly associated respectively with the first arm and with the head part.

2. A ring according to claim 1, wherein one of said first and second parts is formed of a locking portion and the other of a hook portion, intended to co-operate with each other when the head part is in a locked position and disengaged from each other when the head part is in the unlocked position.

3. A ring according to claim 2, wherein the first connecting means comprises a slide associate with at least one arm permitting a translation of the head part relative to the arms, in a direction perpendicular to a pivot axis of said articulation.

4. A ring according to claim 1, wherein said articulation includes at least a hinge secured at least one of said arms and which defines a first pivoting axis, said hinge being masked when the head part is in the locked position and exposed in the unlocked position.

5. A ring according to claim 4, wherein said articulation further includes a second hinge pivoting about a parallel axis to the first axis, and a plate connecting the first hinge to the second hinge, one of the hinges being secured to one of the arms, the other to the other arm.

6. A ring according to claim 1, wherein said head part is arranged so as to be able to pass from one of the locking and unlocking positions to the other by sliding into at least one of said arms.

7. A ring according to claim 6, further comprising: positioning means of the snap-fitting type arranged to co-operate on the one hand with said head part, and on the other hand with one of the arms, to guarantee the locked position of the head part with respect to the arms.

8. A ring according to claim 4, wherein said head part is arranged to pass from one of the locking and unlocking positions to the other by rotating about a second axis perpendicular to the first axis.

9. A ring according to claim 8, wherein at least one of the arms includes a protuberance and the head part a wing, one of said protuberance and wing forming said locking portion, and the other said hook portion.

10. A ring according to claim 2, wherein said head part is mounted so as to pivot on one of the arms via one of its ends, about a third axis, parallel to the first axis and co-operates via the other end with the other arm to form a snap-fitting type assembly.

11. A ring according to claim 1, wherein said connecting means are arranged such that said head part can occupy two locking positions and is provided with a timekeeping device including two distinct displays respectively visible in the first and in the second of said locking positions.

12. A ring according to claim 5, wherein said head part is arranged to pass from one of the locking and unlocking positions to the other by rotating about a second axis perpendicular to the first axis.

13. A ring according to claim 3, wherein said head part is mounted so as to pivot on one of the arms via one of its ends, about a third axis, parallel to the first axis and co-operates via the other end with the other arm to form a snap-fitting type assembly.

14. A body part worn ring, comprising:

a first rigid bent arm having a first arm first end and a first arm second end;

a second rigid bent arm having a second arm first end and a second arm second end;

an articulation connecting said first arm first end and said second arm first end and to provide a pivot connection between said first arm first end and said second arm first end;

a head part arranged in a locked position adjacent to said articulation and in contact with each of said first rigid bent arm and said second rigid bent arm preventing pivoting motion between said first rigid bent arm and said second rigid bent arm, said head part being movable to an unlocked position not in contact with one of said first rigid bent arm and said second rigid bent arm allowing pivoting motion between said first rigid bent arm and said second rigid bent arm;

a first connecting means for securing the head part relative to said first and second arms in said locked position; and a second connecting means for securing said head part relative to said first and second arms in said locked position and releasing said head part relative to at least one of said first and second arms in an unlocked position, whereby upon pivoting motion between said first rigid bent arm and said second rigid bent arm said first arm second end and said second arm second end are separated, such that the ring can be slipped onto or off the wearer's body part through a gap that separates said first arm second end and may be pivoted back to a locked position.

15. A ring according to claim 1, wherein the head blocks the arms from pivoting movement about an axis of said articulation in said locked position.

16. A ring according to claim 14, wherein the arms second ends are free ends not connected to each other in said locked position.

17. A ring, of the type intended to be arranged on a body part of a wearer, the ring comprising:

two rigid bent arms;

an articulation connecting said arms, said arms being mobile facing each other at a first of two ends;

a head part arranged in proximity to the articulation and arranged so as to be able to occupy a first position, called the locking position, and a second position called the unlocking position; and first and second connecting means for securing the head part respectively to the first and second arms, said first and second connecting means both being locked when the head part is in the locked position and at least the first of said connecting means being disengaged when the head part is in the unlocked position, the arms being arranged to occupy:

an open position in which the arms second ends are separated, such that the ring can be slipped onto or off the wearer's body part through a gap that separates the arms second ends, and a closed position in which the gap is reduced, the arms surrounding the wearer's body part, the first connecting means including first and second parts rigidly associated respectively with the first arm and with the head part, wherein said articulation includes at least a binge secured to at least one a said arms and which defines a first pivoting axis, said hinge being masked by said head part when the head part is in the locked position and exposed by said head part in the unlocked position allowing said arms to pivot about the pivot axis.

18. A ring according to claim 17, wherein said articulation further includes a second hinge pivoting about a parallel axis to the first axis, and a plate connecting the fast hinge to the second hinge, one of the hinges being secured to one of the arms, the other to the other arm.

* * * * *